US008561228B2

(12) United States Patent
West

(10) Patent No.: US 8,561,228 B2
(45) Date of Patent: Oct. 22, 2013

(54) COVERING

(75) Inventor: Kathrine West, Victoria (AU)

(73) Assignee: Cozitots Australia Pty Ltd, Victoria (AU)

( * ) Notice: Subject to any disclaimer, the term of this patent is extended or adjusted under 35 U.S.C. 154(b) by 0 days.

(21) Appl. No.: 13/260,792

(22) PCT Filed: Mar. 31, 2010

(86) PCT No.: PCT/AU2010/000368

§ 371 (c)(1),
(2), (4) Date: Sep. 28, 2011

(87) PCT Pub. No.: WO2010/111739

PCT Pub. Date: Oct. 7, 2010

(65) Prior Publication Data

US 2012/0023668 A1 Feb. 2, 2012

(30) Foreign Application Priority Data

Mar. 31, 2009 (AU) ..... 2009901399

(51) Int. Cl.
*A47G 9/02* (2006.01)
*A47G 9/04* (2006.01)
*A47G 9/08* (2006.01)

(52) U.S. Cl.
USPC ..... 5/494; 5/413 R; 5/498

(58) Field of Classification Search
USPC ..... 5/413 R, 494, 498, 499
See application file for complete search history.

(56) References Cited

U.S. PATENT DOCUMENTS

| | | | | | |
|---|---|---|---|---|---|
| 1,863,256 | A | | 6/1932 | Snoddy | |
| 1,964,271 | A | | 6/1934 | O'Dwyer | |
| 2,239,017 | A | * | 4/1941 | Roberts | 5/498 |
| 2,627,617 | A | * | 2/1953 | Avila | 5/494 |
| 3,003,164 | A | | 10/1961 | Calvelage | |
| 3,083,378 | A | * | 4/1963 | Pursell | 5/498 |
| 4,161,044 | A | * | 7/1979 | Bogle | 5/494 |
| 4,241,466 | A | | 12/1980 | Mendyk | |
| 4,546,508 | A | | 10/1985 | Ison | |
| 5,084,929 | A | * | 2/1992 | Staudinger | 5/494 |
| 2008/0072378 | A1 | | 3/2008 | Head | |

FOREIGN PATENT DOCUMENTS

| | | | |
|---|---|---|---|
| AU | 772185 | B2 | 3/2000 |
| AU | 2007100837 | A4 | 10/2007 |
| WO | 9956598 | A1 | 11/1999 |
| WO | 0076376 | A1 | 12/2000 |

OTHER PUBLICATIONS

International Search Report for PCT/AU2010/000368, Completed by the Australian Patent Office on May 5, 2010, 3 Pages.

* cited by examiner

*Primary Examiner* — Michael Trettel
(74) *Attorney, Agent, or Firm* — Brooks Kushman P.C.

(57) ABSTRACT

A device for covering a human or animal at rest on a surface comprising a support to reversibly fix the device relative to the surface, and an adjustable covering to cover the human or animal wherein the covering is reversibly fixable at a length so as to ensure that the human or animal's face is not covered by the device.

8 Claims, 7 Drawing Sheets

COVERING

CROSS-REFERENCE TO RELATED APPLICATION

This application is the U.S. national phase of PCT Appln. No. PCT/AU2010/000368 filed Mar. 31, 2010, which claims priority to Australian application 2009901399 filed Mar. 31, 2009, the disclosures of which are incorporated in their entirety by reference herein.

BACKGROUND TO THE INVENTION

Conventional beds and cots for babies, when used with conventional blankets and sheets and the like, can have a variety of problems associated with them.

For example, it can be difficult to maintain the bedding in an appropriate position around the infant as it moves around while it sleeps; a child can also become cold if out of the bedding. Alternately a child tangled in bedding can become, overheated. The above mentioned problems not only cause restless nights but they can become serious hazards.

The campaign for sleeping on the back introduced by SIDS has greatly decreased the number of SIDS related deaths; however there are still around 134 deaths per year attributed to SIDS in Australia alone. Studies have shown that the risk of SIDS becomes greatly increased when an infant's face becomes covered by bedding.

There remains the need to provide a more effective apparatus to assist in reducing SIDS in infants.

The reference to any prior art in this specification is not, and should not be taken as, an acknowledgement or any form of suggestion that the prior art forms part of the common general knowledge.

SUMMARY OF THE INVENTION

According to a first aspect of the invention, there is provided a device for covering a human or animal at rest on a surface comprising a support to fix (optionally reversibly) the device relative to the surface, and an adjustable covering to cover the human or animal wherein the covering is fixable (optionally reversibly) at a length so as to ensure that the human or animal's face is not covered by the device.

The device may be made from any suitable materials. Examples include fabric, polymeric materials, etc. The reason for covering may be for any suitable reason, such as warmth, restraint, protection (such as from UV radiation, or for damaged tissue), and so on. The surface may be of any suitable type on which a human or animal can rest. Thus it would include horizontal surfaces such as a bed or floors, but may also include vertical or semi vertical surfaces such as a chair or seat. Similarly, the invention may have application in a wide range of environments. Thus for example, environments where the human or animal requires restraint for safety reasons, such as at in a moving vehicle, during earthquake, at lower gravitational levels, and so on.

The support may be of any suitable type. Thus for example, it may comprise fasteners such as VELCRO fasteners or clips or press studs, or zips which engage to fix the device to and/or stationery relative to the surface. In some embodiments it may comprise a sleeve which goes over a mattress (which comprises the surface).

The adjustable covering can be of any type suitable for the application at hand. Thus it may be a warm covering, or one that blocks UV, or allows air to circulate but blocks contamination, and so on. Adjustment of the covering may be done by any suitable means. In some embodiments it is done by a series of folds and tucks of the covering. In others, elements of the covering are added or subtracted as need be. In others, the covering's size can be dynamically adjusted, for example with one or mole fasteners that hold different elements of the covering in proximity to one another unless they are released. Fixing of the covering can be done by any suitable means.

In some embodiments, the device is for use with a human or animal in a state of debilitation. It is commonly the case that a debilitated human or animal must be covered to keep them warm, or in some cases restrained. However, the state of debilitation may mean that the human or animal is unable to remove coverings that may inadvertently fall over his, her or its face. The present invention substantially reduces the risk of such an event occurring. Examples of debilitation may for example include, post-anaesthetic, serious illness, old age, etc.

In some embodiments, the device is for use with an infant and wherein the surface optionally is comprised horn one or more of a bed, cot, car seat, cradle, bassinet, sleeping mat, flooring, or any other suitable surface. In some embodiments, the device is for use with one or more of a bed, cot, car seat or cradle, sleeping mat, flooring, bassinette, cradle, port-a-cot, toddler bed or other bed mattress, or any other suitable surface.

In some embodiments wherein the support comprises a sleeve which may be optionally used to cover an item comprising the surface, such as a mattress.

Throughout tills specification (including any claims which follow), unless the context requires otherwise, the word 'comprise', and variations such as 'comprises' and 'comprising', will be understood to imply the inclusion of a stated integer or step or group of integers or steps but not the exclusion of any other integer or step or group of integers or steps.

BRIEF DESCRIPTION OF THE DRAWINGS

Certain exemplary embodiments of the invention will be described in further detail with reference to the drawings and their relevant numbers.

FIG. **6*a*** is the accessory blanket showing the second variation on the invention.

FIG. **6*b*** is the accessory blanket designed to fit the third variation with slight changes to the placement of press studs.

Figure 7:
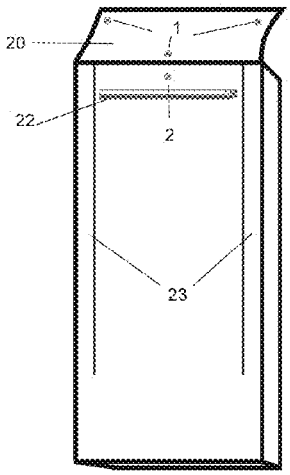

FIG. 7 shows the front view with the second variation, inclusive of a fold-over flap.

Figure 8:
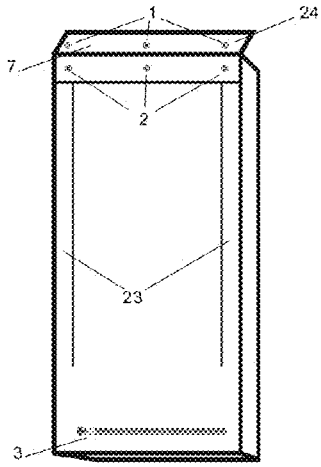

FIG. 8 shows the front view with the third variation of a lift-up tab-top.

Figure 9:
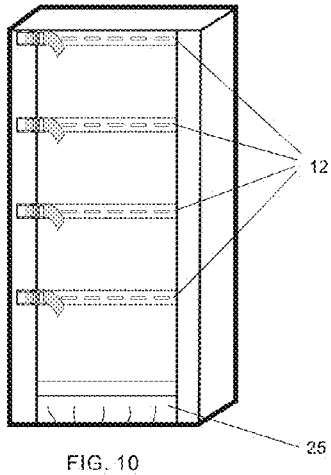

FIG. 9 Shows the reverse side of the device with a variation to the materials used at die back.

Figure 10:
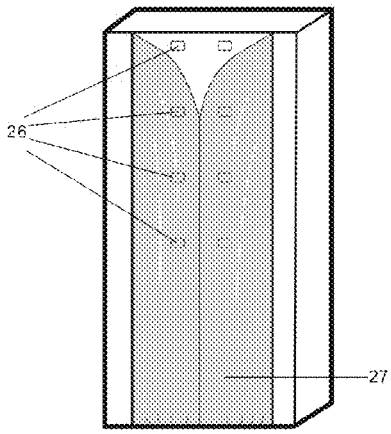

FIG. 10 shows a variation of materials used on the reverse side and how it would function differently using different fixing material.

Figure 11:
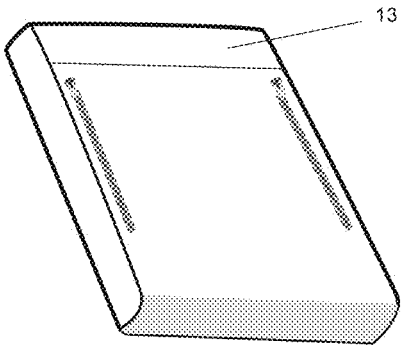

FIG. 11 depicts the device as it would be seen from the front/top with the fold-over flap in its normal position.

Figure 12:
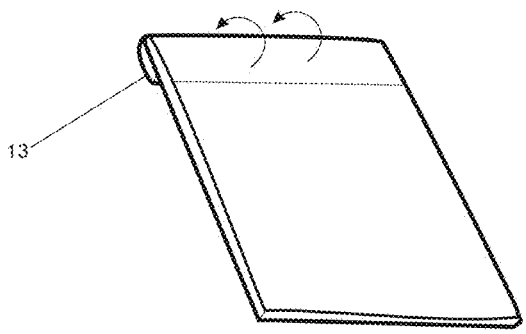

FIG. 12 shows the fixed fold-over flap having been turned inside out over the opening and sealing it.

Figure 13:
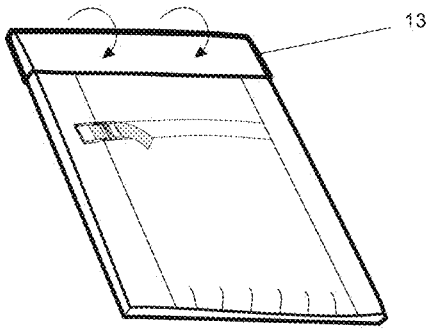

FIG. 13 shows an example device from the reverse side with the fold turned over.

Figure 14:
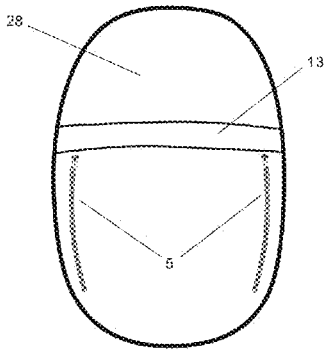

FIG. 14 shows an example device being used on a bassinette mattress.

Figure 15:
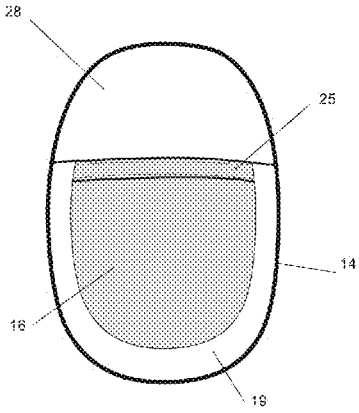

FIG. 15 shows an example reverse side of the bassinette device.

Figure 16:
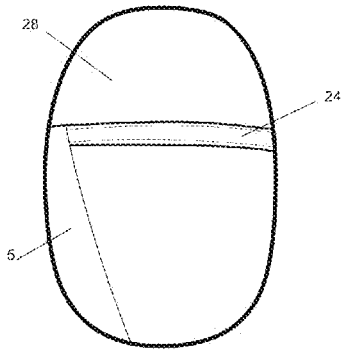

FIG. 16 shows a variation in the placement of zipper and a tab-top.

Figure 17:
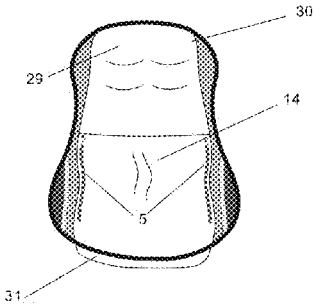

FIG. 17 Shows an example device being used in a car or pram capsule setting.

Figure 18:
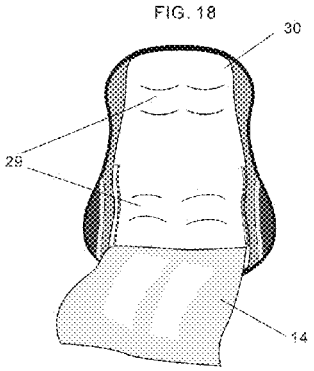

FIG. 18 shows an example device as it would look when open.

Figure 19:
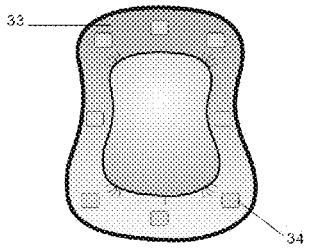

FIG. 19 shows an example back of the device which resembles a fitted sheet backing.

Figure 20:
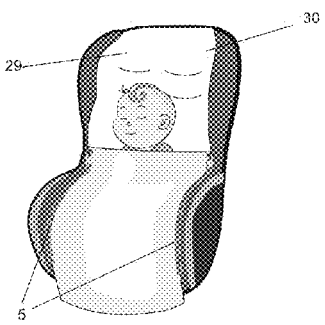

FIG. 20 shows an example device being used in a child safety seat.

Figure 21:
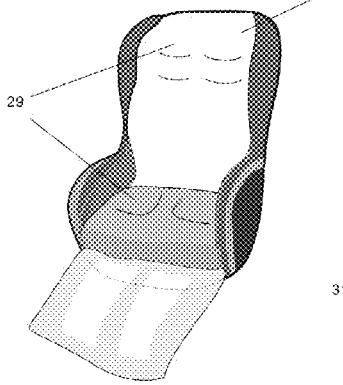

FIG. 21 shows an example device as it would look when open.

Figure 22:
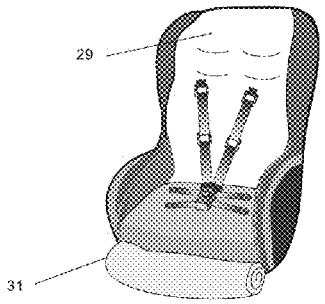

FIG. 22 shows an example device as it would look when the top section is rolled away into the cavity/pocket at foot of the device.

FIGS. 23*a-h* shows an example use of a device according to the invention.

DETAILED DESCRIPTION OF PREFERRED EMBODIMENTS

It is convenient to describe the invention herein in relation to particularly preferred embodiments. However, the invention is applicable to a wide range of embodiments and it is to be appreciated that other constructions and arrangements are also considered as falling within the scope of the invention. Various modifications, alterations, variations and or additions to the construction and arrangements described herein are also considered as falling within the ambit and scope of the present invention.

This invention relates to the area of beds and bedding and in particular to the area of beds and the like for babies which provide a secure resting place for the baby. IN some embodiments, the invention permits the bedding to remain in a preferred orientation on the mattress and includes the ability to replicate the 'feet to foot' method, of making up a safe bed recommended by SIDS. In some embodiments, the device also allows for temperature control through removal or addition of secured layers.

In some embodiments the invention consists of an all-in-one fitted device which is adapted to fit over car safety capsules and seats.

In some embodiments, the invention consists of a sleeve-like bedding device adapted to pass over a bassinette, cradle, cot, port-a-cot, toddler bed or other bed mattress, without exclusion of pram cradles. The first opening end passes over a mattress to the point whereby the body's upper portion can extend through this opening safely, whilst still staying covered at least to the shoulders. Depending on length of the occupant; there may be an excess of device at the foot of mattress; it is intended that this excess be tucked under the mattress.

In some embodiments, it is preferred that the bedding device be provided with a zip or other suitable means of fastening at either side of the upper centre surface of the device to allow for access. The first opening end of the bedding device may encompass a fixed fold-over flap that can house additional blanket layers. Variations to this option include a fold-over flap that is not fixed or a tab. Under each of the previous mentioned options there is provision for securing/fixing the additional layers of blanket to the device. The reverse side of the device may be fitted with a means of tightening the device so as to adjust the width. The top exterior of the device may form a fitted coverlet over the baby, adding to this is an insert opening whereby a quilt or liner may be included in order to adjust the warmth of device.

Some of the advantages of various embodiments of the invention comprise:

- Due to its width adjustability, it assists infants to stay sleeping on their back.
- Keeps infant from becoming too cold or too hot thus waking and more importantly reduces risk factors associated with SIDS.
- Allows the carer to adjust the temperature of bedding securely, with minimal disturbance to the sleeping infant.
- Ensures that the bedding will stay in its correct orientation thus preventing the blanket from becoming tangled and reducing the risks associated with head covering by blankets.

In some embodiments, the invention takes the form of a sleeve like bedding device adapted to pass over the cot or other bed mattress through the open end of the device. It is intended that the mattress is fitted with a regular fitted sheet.

In some embodiments, the device may also comprise a fitted sheet. The device is intended for use in; bassinettes, cradles, cots, port-a-cots and beginner beds. The invention is such that it can be adapted and adjusted in size to fit a range of bedding. The device has been designed to replicate the 'feet to foot' method of making up a bed recommended by SIDS. Tire device can be adjusted to accommodate the growth of a child both in breadth and length. Another unique feature of the device is that the layers of warmth can be adjusted with minimal disturbance to the child, whilst at the same time providing bedding that stays in place.

Figure 1:
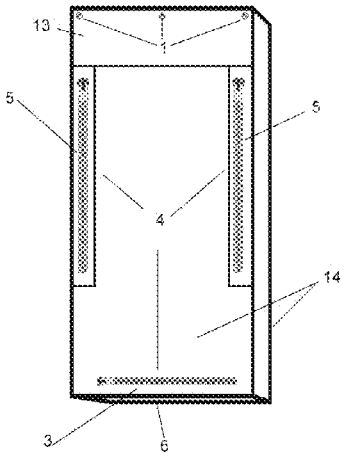
FIG. 1 shows the fixed fold-over front view of the invention and the first of three variations.

FIG. 1 shows the first of three exemplary embodiments in the front view of the device. 13 shows the fold-over flap designed to replicate a top sheet. It is intended that the fabric be cotton, percale, bamboo or other like materials of suitability. The fold-over flap is fixed to the sides and forms a pocket like enclosure where the accessory blanket 9 is inserted underneath and secured by press studs/VELCRO fasteners, ties, buttons or some other means at any preferred position. The zippers 5 run down the sides of the device and are covered by a tab 4. Whilst zippers are the preferred means of closure; fixing and closing devices such as VELCRO fasteners, buttons, ties or other suitable devices could also be fitted. It is intended that the fabric for the top and sides 14 of the device be cotton, cotton waffle, percale, bamboo or other like materials of suitability. The side panels 14 will be lined with a natural batting material or the like, in order to keep the device insulated when fully extended; the top section may include batting in the instance of an insert quilt being omitted for the design. The device can pass over the entire body of the mattress by way of an opening 17 at the top. It will pass up the mattress to pillow/height at which point it is stopped by the foot panel 6 made from the same fabric as suggested for the top and sides 14. The device may only be passed up to shoulder height to suit the length of the occupant, whereby the excess at foot of device is tucked under the body of the mattress. At the foot end on the top section, there is an opening 3 whereby the quilt insert is passed through up into the body of the device and secured by press studs/VELCRO fasteners, ties, buttons or some other means at any preferred position. The opening 3 is dosed using a zipper, press studs/VELCRO fasteners, ties, buttons or some other suitable means.

Figure 2:
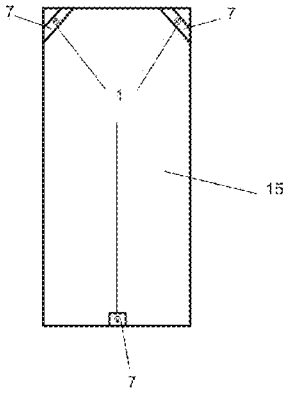
FIG. 2 is the inside lining of the invention (top-sheet).

FIG. 2 Is the inside lining 15 (top sheet). It is intended that this be made up of cotton, percale, bamboo or other like materials of suitability. At the top corners and at the centre of the foot of lining there are male press studs 1 applied to hold the quilted insert 18 in place. It is intended that other methods of holding the insert in place can also be applied, such as VELCRO fastener, ties or buttons. Underneath the said fastening methods there will be a piece of reinforcement tape/material 7 used to reinforce such applications.

Figure 3:
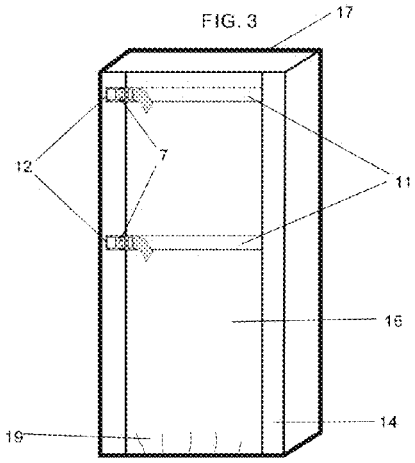
FIG. 3 shows the reverse side of the invention.

FIG. 3 shows the reverse side of the device. The centre panel 16 is made up of a jersey knit or poly/cotton fabric in older to allow for flexibility when the device is at its fullest extension in breadth. It is attached to the foot panel 6 by way of a gather stitch at the base of the device. The device could also be constructed without the centre panel of fabric using just straps 12 as depicted in FIG. 9. The straps 12 shown in FIG. 3 are inserted into a channel of fabric 11 made up of percale, jersey knit, or poly/cotton. The straps 12 are stitched at either the left or right side, depending on whether they are manufactured in a left or right handed orientation. FIG. 3 shows a right handed orientation; meaning sown at right side and pulled tight using right handedness. The straps 12 are intended to be like those used in child restraints. They are pulled through the channel to form the desired breadth of device, thus forming a gather. The opposing clip is attached at the left side where there will be a piece of reinforcement tape/material 7 used to reinforce such applications. The two clips are then clipped together. Other variations on this theme include using cord and toggles, elastic and buttons or luggage strap and buttons.

Figure 4:
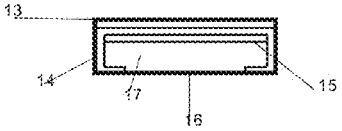
FIG. 4 shows the top view of the inventions' opening end and its layers.

FIG. 4 Shows the horizontal layered view looking into the open end 17 of the device.

Figure 5:
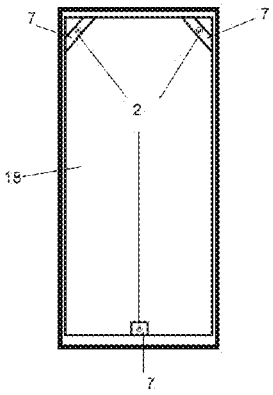
FIG. 5 is the quilt insert.

FIG. 5 is the quilted insert. It is intended that the device can be used with or with out this accessory. It may not be required in warmer climates. It is intended that the insert be made up of any of the following materials; wool, cotton, bamboo, silk and other natural plant fibres. It may also be made up of other suitable materials. The quilt insert 18 is held in place by attaching the female press studs 2 onto the male press studs 1 on the lining 15. It is intended that other methods of holding the insert in place can also be applied, such as VELCRO fastener, ties or buttons. Underneath the said fastening methods, there will be a piece of reinforcement tape/material 7 used to reinforce such applications.

Figure 6:
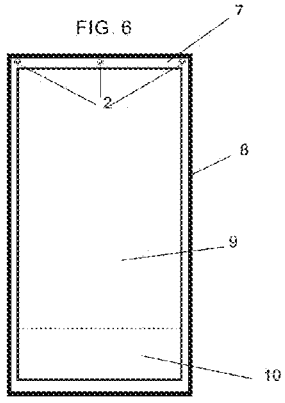
FIG. 6 is the accessory blanket.

FIG. 6 is the accessory blanket 9 made up of brushed cotton, wool, bamboo or other natural fibres. It may also be made up of other suitable materials. It is intended that they can be added or taken away according to the level of temperature required. One or more can be fitted securely or taken away with minimal disturbance to the child. Both sides of the accessory blanket 9 are fitted with press studs at the top; female on one side and male on the other side. It is intended that the blanket 9 is passed up under the top fold and secured with the press studs on the opposing fabric being the top layer 14, with male and female press studs meeting. Additional blankets can then be added and so on. Any excess of blanket remaining 10 at the foot of cot it will be tucked in the standard manner as depicted in FIG. 23*f*. The edges of blanket 8 will be bound with satin, cotton, bamboo or other suitable textile with mitred corners. The reinforcement tape/material 7 will be shown within the binding, at the top of blanket.

Figure 6A:
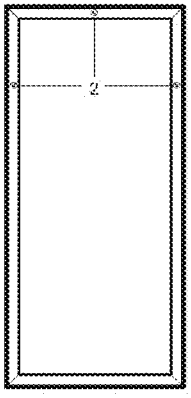

FIG. 7 shows the fold-over flap is not fixed and lifts up to allow for the application of the accessory blankets. Whilst the zippers 23 are still concealed they are no longer cover by a tab. The insertion point 22 for the quilted insert has been moved to the top of the centre section. The male and female press studs, VELCRO fastener, ties or buttons have changed position to meet with opposing fixing points 2 on the accessory blanket shown in FIG. 6*a*. They may be changed to suit any preferred position.

Figure 6B:
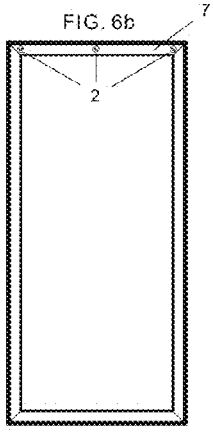

FIG. 8 Shows the variation of a tab-top 24 design whereby the fold-over flap becomes much shorter in order to simply house the fixing points 1, 2 for the accessory blankets. The fixing points are in a line at the top of the centre section and will be reinforced 7 within tire tab-top 24. The fixing points 2 on the accessory blanket shown in FIG. 6*b* are in opposing positions to meet with the fixing points on the tab-top and are also reinforced. The zippers 23 are still concealed and are no longer covered by a tab. The insertion point 3 remains at the foot of the centre section.

FIG. 9 Shows the reverse side of the device with the variation of straps 12 and no material present in the centre panel. Four or more straps are spread evenly down the back of the device. The foot panel 25 extends around the base of the device and a channel lined with elastic or elastic bound to form a gather and hold the foot of the device to the mattress is present.

FIG. 10 shows the variation of the centre panel on the reverse side of device 16 being made wider and having a gathered effect. It is tightened by attaching Velcro™ 26 from one side over to the other at varying places for difference in breadth requirements.

FIG. 11 shows the device in its normal orientation and the fixed fold-over flap 13 being in its normal orientation before being turned into a mat or floor rug for an infant or child to use during tummy-time or play-time.

FIG. 13 shows the fold-over flap 13 having been turned inside-out and hence covering over the opening at the top end 17 of the device.

FIG. 14 shows the device being used on a bassinette mattress 28. It has the same features as FIG. 1 being zippers 5 down each side and a fixed fold-over flap 13 at the top however it has rounded corners at the foot of device in order to fit the mattresses dimensions.

FIG. 15 shows the reverse side of the device. The top of the device has a channel of elastic 25 at the top to keep it firm on the mattress. Unlike other models, this one does not require differing depths as the child quickly moves from the bassinette to the cradle or cot, where there is provision for adjustment in depth. The top and side 14 are one piece of material that wrap around the mattress. There is a gather stitch 19 at the foot of device and the back panel 16 is made up of jersey knit or poly/cotton.

FIG. 16 shows the zipper 5 in a different place running diagonally across the device with a tab-top 24 as shown in FIG. 8 the reverse side of the device remains the same as depicted in FIG. 15.

FIG. 17 shows a car or pram capsule 30 device based on the same theme however, the top side of the device is attached to a fitted backing 33 which goes over the capsule. Slits 29 are present to allow the harness to be passed through the device so that it can remain safely in place. It is intended that a fastening device such as VELCRO fastener. 34 with an adhesive back be provided with the device, so as to include these around the fitted sides 33 and attach them to the capsule to assist in holding the device in place. At the foot of the capsule is a pouch 31 where the centre section can be rolled and stowed neatly when not in use.

FIG. 18 shows the device with the centre section folded down.

FIG. 19 shows the reverse side of the device resembling a fitted sheet. Velcro™ 34 squares are attached to the edges at intervals and adhesive VELCRO fastener tapes would be supplied with the device to be placed on the owners' capsule.

FIG. 20 shows the device being used in a child safety seat for cars. Its functionality is very similar to FIG. 17 however, it has an excess a the foot so as to accommodate growing children whilst at the same time providing a pouch 31 to roll and stow the centre section in when not in use.

FIG. 21 shows the centre section unzipped.

FIG. 22 shows the centre section neatly rolled and stowed in the excess at the foot of device.

All the devices will vary in measurement according to the many varied sizes available. Whilst these designs are based on standard baby/toddler bed measurements it is intended in the scope of the design to include other variables in relation to mattress sizes. The same can be said for the baby car/pram capsule and child car safety seat. The bassinette device is also applicable to prams that have a bassinette component.

FIGS. 23*a-h* demonstrate one example use of a device according to the invention.

Figure 23A:
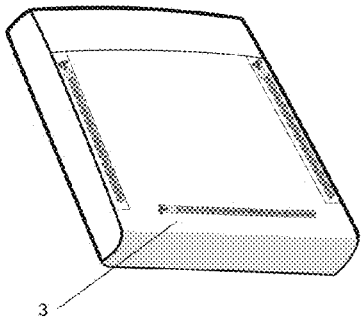

FIG. 23*a*. Open quilt insertion point 3 and insert or remove accessory quilt depending on level of warmth required.

Figure 23B:
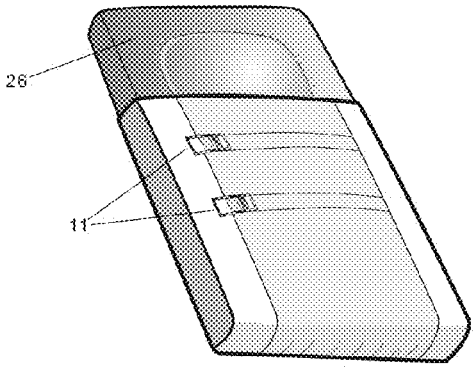

FIG. 23*b*. A standard fitted sheet is placed over the mattress 26.

Loosen straps 11 on the reverse side of device.

Figure 23C:
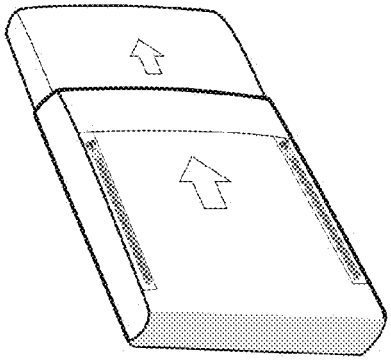

FIG. 23*c*. Slip the device up over the body of the mattress to the point that matches the child's height to the shoulders.

Figure 23D:
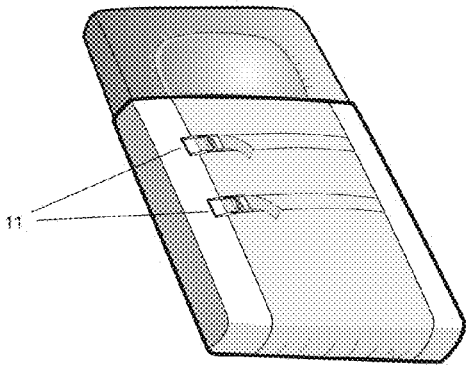

FIG. 23*d*. Tighten the Straps 11.

Figure 23E:
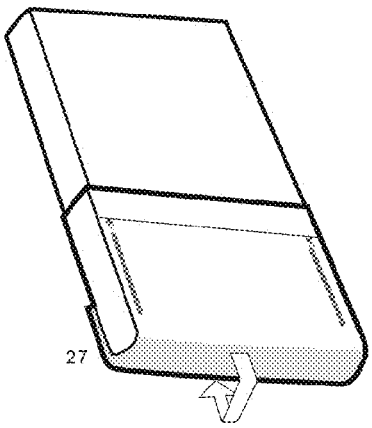
Figure 23F:
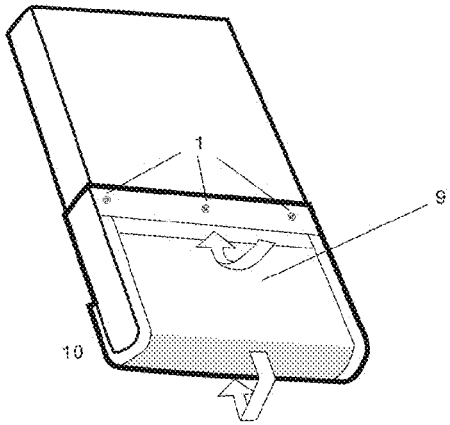
Figure 23G:
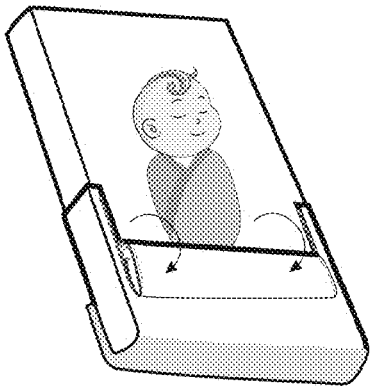
Figure 23H:
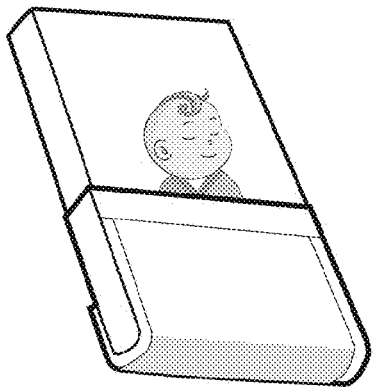

FIG. 23*e*. In the case of there being an excess 27 remaining at the foot of device due to a smaller infant fitting; neatly fold the excess under the body of the mattress. It is intended that the weight of the mattress will hold the said fold in place.

FIG. 23*f*. Should the accessory blanket/s 9 be required for additional warmth, place on top of device and slide up underneath top fold-over flap and place the corresponding male and female press studs 1 together. Further layers of accessory blankets can be added in the same way. Any excess remaining is tucked down at the foot of the cot in the standard manner.

The invention claimed is:

1. A device for covering a baby while resting on an upper surface of an item, the device comprising:

a sleeve including an open end sized to receive a portion of the item, the sleeve having an lower sheet that acts as an encasement about a lower surface of the item, the sleeve further having a foldable upper sheet having two layers which are releasably engaged to the lower sheet for partially covering the upper surface of the item when the part of the item is received within the sleeve, wherein the upper sheet includes a closable opening extending through one of the two layers for receiving a supplementary blanket or quilt between the two layers of the upper sheet such that the upper sheet encapsulates the supplementary blanket or quilt; and an adjustable strap attached to opposite sides of on the lower sheet to enable the sleeve to secure about the item at a locations such that only a portion of the item is received within the sleeve along a length of the item;

wherein the upper sheet is releasably engaged to the remainder of the sleeve such that the upper sheet along with the encapsulated supplementary blanket or quilt is enabled to fold away in their entirety from the sleeve and uncover the baby.

2. The device according to claim 1, wherein the sleeve has a closed end which forms a continuous loop covering the upper surface, the lower surface, and side surfaces of the item.

3. The device according to claim 2, further comprising a plurality of straps that enable the sleeve to cover each of the surfaces of the item at multiple lengths along the item.

4. The device according to claim 1, wherein the item is a mattress having a length, and wherein the sleeve is a continuous sleeve when the upper sheet is engaged with the lower sheet, and wherein the straps enable the continuous sleeve to be secured to entirely cover all surfaces of mattress up to the length of the mattress.

5. The device according to claim 1, wherein the item is comprised of one or more of a bed, mattress, cot, car seat, bassinet, sleeping mat, or flooring.

6. The device according to claim 1 further comprising a fastener at either side of an centre surface of the device to releasably secure the lower sheet to the upper sheet and allow for access within the sleeve.

7. The device according to claim 6 wherein the fastener is one or more of a zip, hook and loop fasteners, or buttons.

8. The device according to claim 1 wherein the upper sheet of the device forms a fitted coverlet over the baby.

* * * * *